US009759386B2

(12) United States Patent
Wu et al.

(10) Patent No.: US 9,759,386 B2
(45) Date of Patent: Sep. 12, 2017

(54) REDUCING FRICTION OF A VISCOUS FLUID FLOW IN A CONDUIT

(71) Applicant: COMMONWEALTH SCIENTIFIC AND INDUSTRIAL RESEARCH ORGANISATION, Campbell, Australian Capital Territory (AU)

(72) Inventors: Jie Wu, Highett (AU); Lachlan Graham, Highett (AU); Gregory Mark Short, Highett (AU); Dean William Harris, Highett (AU)

(73) Assignee: COMMONWEALTH SCIENTIFIC AND INDUSTRIAL RESEARCH ORGANISATION, Campbell (AU)

( * ) Notice: Subject to any disclaimer, the term of this patent is extended or adjusted under 35 U.S.C. 154(b) by 254 days.

(21) Appl. No.: 14/368,065

(22) PCT Filed: Feb. 7, 2013

(86) PCT No.: PCT/AU2013/000109

§ 371 (c)(1),
(2) Date: Jun. 23, 2014

(87) PCT Pub. No.: WO2013/116902

PCT Pub. Date: Aug. 15, 2013

(65) Prior Publication Data

US 2014/0360587 A1 Dec. 11, 2014

(30) Foreign Application Priority Data

Feb. 7, 2012 (AU) ..... 2012900442

(51) Int. Cl.
*F17D 1/17* (2006.01)
*F17D 1/16* (2006.01)
(Continued)

(52) U.S. Cl.
CPC ..... *F17D 1/17* (2013.01); *F15D 1/008* (2013.01); *F15D 1/06* (2013.01); *F17D 1/16* (2013.01);
(Continued)

(58) Field of Classification Search
CPC ..... Y10T 137/0391; Y10T 137/2076; Y10T 137/2082; Y10T 137/0329;
(Continued)

(56) References Cited

U.S. PATENT DOCUMENTS 316,804 A * 4/1885 Messinger ..... F04F 5/46 417/151
445,909 A * 2/1891 Shontz ..... B01F 5/0496 137/205.5
(Continued)

FOREIGN PATENT DOCUMENTS

DE 3605723 A1 8/1987
WO WO 90/08083 A1 7/1990
WO WO 2009070512 A1 * 6/2009 ..... F16K 47/04

OTHER PUBLICATIONS

International Search Report, mailed Mar. 22, 2013 in connection with PCT International Application No. PCT/AU2013/000109, filed Feb. 7, 2013.
(Continued)

*Primary Examiner* — Craig J Price
(74) *Attorney, Agent, or Firm* — John P. White; Cooper & Dunham LLP

(57) ABSTRACT

A device for reducing friction of a viscous fluid flow in a conduit is disclosed. The device comprises a body positionable to define at least a segment of a flow path for the viscous fluid in or contiguous with the conduit, a cavity in the body for retaining lubricating fluid, and at least one port in the body for delivering lubricating fluid to the cavity. A fluid
(Continued)

outlet arrangement from said cavity delivers lubricating fluid to the flow path to form a downstream lubricating film at the conduit surface. The fluid outlet arrangement comprises a substantially continuous opening or ring of close spaced openings, effective collectively to reduce the pressure variation and therefore velocity variation of the delivered lubricating fluid along said outlet arrangement.

11 Claims, 5 Drawing Sheets

(51) Int. Cl.
*F15D 1/06* (2006.01)
*F15D 1/00* (2006.01)

(52) U.S. Cl.
CPC .... *Y10T 137/0391* (2015.04); *Y10T 137/2076* (2015.04); *Y10T 137/2082* (2015.04)

(58) Field of Classification Search
CPC ..... Y10T 137/2087; Y10T 137/7855; Y10T 137/7856; Y10T 137/7857; Y10T 137/87652; Y10T 137/8766; Y10T 137/87668; Y10T 137/3112; Y10T 137/87587; Y10T 137/2529; Y10T 137/2526; Y10T 107/0391; Y10T 107/2076; Y10T 107/2082; F17D 1/17; F17D 1/16; F15D 1/008; F15D 1/06; F15D 1/16
USPC ..... 137/3, 205.5, 888, 101.11, 101.19, 13, 137/896–898, 515.3, 515.5, 515.7, 806, 137/807, 602, 889–891; 366/162.1, 366/163.1, 167.1, 173.1, 173.2, 163.2, 366/366; 417/151, 194, 197; 251/127; 239/344; 406/47–48, 93–95; 138/39, 97
See application file for complete search history.

(56) References Cited

U.S. PATENT DOCUMENTS 708,200 A * 9/1902 Bushnell ..... F04F 5/466 15/409
992,144 A * 5/1911 Babcock ..... B01F 5/0415 239/434.5
2,821,205 A * 1/1958 Chilton ..... F15D 1/06 137/13
3,175,571 A 3/1965 Bankert
3,414,004 A 12/1968 Bankston
3,502,103 A 3/1970 Verschuur
3,708,207 A 1/1973 Steele
4,046,492 A * 9/1977 Inglis ..... F04F 5/46 417/197
4,510,958 A 4/1985 Coursen
4,969,481 A * 11/1990 Horii ..... B65G 53/14 137/13
5,172,890 A * 12/1992 Horii ..... G02B 6/4464 254/134.4
5,479,957 A 1/1996 Crow et al.
6,196,269 B1 * 3/2001 Michael ..... B05B 7/1404 137/888
6,352,639 B2 * 3/2002 Ito ..... B01J 8/1827 208/113
6,460,936 B1 * 10/2002 Abramov ..... E21B 21/12 175/40
6,623,154 B1 * 9/2003 Garcia ..... B01F 5/0415 137/888
6,851,896 B1 * 2/2005 Flynn ..... C22B 34/1222 406/197
7,111,975 B2 * 9/2006 Fenton ..... F04F 5/24 137/889
7,927,565 B2 * 4/2011 Duyvesteyn ..... B01F 5/0256 156/345.33
8,435,402 B2 * 5/2013 Duyvesteyn ..... B01J 19/26 208/106
8,505,310 B2 * 8/2013 Zhang ..... F01D 9/065 417/179
8,585,011 B2 * 11/2013 Caprera ..... F16K 47/04 137/625.3
2005/0061378 A1 * 3/2005 Foret ..... F04F 5/04 137/888
2005/0150971 A1 * 7/2005 Zhou ..... B01J 2/04 239/1
2010/0232996 A1 9/2010 Stabel

OTHER PUBLICATIONS

Dec. 15, 2015 Extended European Search Report, including Supplementary Search Report and European Search Opinion, in connection with European Patent Application No. 13747268.4.

* cited by examiner

REDUCING FRICTION OF A VISCOUS FLUID FLOW IN A CONDUIT

CROSS-REFERENCE TO RELATED APPLICATIONS

This application is a §371 national stage of PCT International Application No. PCT/AU2013/000109, filed Feb. 7, 2013, claiming priority of Australian Patent Application No. 2012900442, filed Feb. 7, 2012, the contents of each of which are hereby incorporated by reference in their entirety.

FIELD OF THE INVENTION

This invention relates generally to the reduction of friction of a viscous fluid flow in a conduit by injection of a lubricating fluid between the viscous fluid and the wall of the conduit. The invention has particular application to the conveyance of thickened slurries in mining and mineral processing plants, but is also applicable in the transport of highly viscous fluids in a variety of other industries for example, the oil, cement, polymer, food and pharmaceutical industries.

BACKGROUND OF THE INVENTION

Thickened slurries are favoured for the transport of particulate solid streams in mining and mineral processing. Benefits include reduced water consumption and reduced impact on the environment, and the greater ease of turn down and restart operations. Processes involving the conveyance of high viscosity materials are also found in a variety of other industries, for example the pumping of concrete in the construction industry, crude oil in the oil industry, fly ash in the power industry, and in food and pharmaceutical preparations. The viscous fluid may consist of a single phase or multiple phases.

The benefits however come with a cost since the increased friction loss arising with increasing viscosity elevates pressures and power requirements for conveying viscous materials. Sometimes the pressure required is so high that the capital cost for pumping equipment and the operating energy cost become unacceptably high.

To address these issues, there have been a number of proposals for reducing friction between viscous fluid flows and the conveying conduit, by injecting a lubricating fluid, often water, in an attempt to form a lubricating film between the viscous fluid flow and the wall of the conduit. For example, U.S. Pat. No. 5,361,797 discloses a system for injecting a lubricating fluid such as water, an oil or a polymer solution into the conduit interior from an annular reservoir via a thin circumferential slit that is inclined to direct the lubricating fluid in the direction of slurry flow. The lubricating fluid is delivered in turn to the reservoir through one or a number of feed ports. Tests have shown that the delivery of the lubricating fluid from the circumferential slit is significantly non-uniform resulting in uneven film distribution about the viscous flow and a circumferentially variable downstream effect of the lubrication. These difficulties are likely to be amplified in the arrangement of U.S. Pat. No. 5,605,174 in which lubricating fluid is delivered to the interior of a pipe section via drilled radial holes.

The peripheral unevenness of lubricant injection in these arrangements can be partially offset by increasing the volume of lubricant delivered at the injection station. In typical systems employing water as the lubricating fluid, the resulting proportionate total addition of water, especially where a number of devices are provided over a longer pipeline, may be unacceptable and detrimental to the process, or simply so high as to offset the potential advantages of employing the thickened slurry or viscous fluid as a means of transport.

The present applicant's international patent publication WO2011/050405 discloses a system for reducing friction of viscous fluid flowing in a conduit in which a lubricating fluid is passed under pressure through a porous conduit that defines a portion of the passage guiding the flow. While this configuration is initially effective in delivering lubricating fluid in a peripherally uniform manner, and is therefore suitable for many applications, some applications require the use of suitably treated water to avoid longer term clogging of the conduit pores by finer particles that are inevitably present in the available water supply.

It is an objection of this invention to achieve effective lubrication of a viscous fluid flow in a conduit in a manner that is peripherally substantially uniform but preferably does not entail a potential additional requirement for pre-treated lubricating fluid.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY OF THE INVENTION

The invention provides, a device for reducing friction of a, viscous fluid flow in a conduit, the device comprising:

a body positionable to define at least a segment of a flow path for the viscous fluid in or contiguous with the conduit;

a cavity in the body for retaining lubricating fluid, and at least one port in the body for delivering lubricating fluid to the cavity; and a fluid outlet arrangement from said cavity for delivering lubricating fluid to the flow path to form a downstream lubricating film about viscous fluid flowing therein;

wherein said fluid outlet arrangement comprises a substantially continuous opening or ring of close spaced openings about the flow path, and said cavity comprises an array of passages in said body that includes a plurality of elongate passages that extend about said flow path effective collectively to reduce the pressure variation and therefore velocity variation of the delivered lubricating fluid along said outlet arrangement.

The invention further provides a method of reducing friction of a viscous fluid flow in a conduit, comprising delivering lubricating fluid to the flow from a cavity via an outlet arrangement, wherein said fluid outlet arrangement comprises a substantially continuous opening or ring of close spaced openings about the flow, and said cavity comprises an array of passages in said body that includes a plurality of elongate passages that extend about said flow effective collectively to reduce the pressure variation and therefore velocity variation of the delivered lubricating fluid along said outlet arrangement.

In a preferred form, the cavity comprises an annular chamber about the flow path and the elongate passages include a plurality of grooves spaced apart between said at least one port and said fluid outlet arrangement on one or other of opposed faces of the annular chamber.

There are typically three to seven such grooves: it is found that the higher the number of spaced grooves, the less the variation in the velocity of the delivered lubricating fluid along the outlet arrangement. The grooves are conveniently arcuate or annular about the flow path.

Preferably, the annular chamber exhibits an elongated cross-section that is relatively substantially wider in one direction and relatively substantially narrower in another direction orthogonal to said one direction, whereby said elongated cross-section defines a first annular and a second annular end of said chamber. Conveniently, the fluid outlet arrangement comprises an open end of the annular chamber at the first end. At least one port may typically be at the second end of the annular chamber.

In a first embodiment, the annular chamber is relatively wide in a radial direction relative to an axis of the viscous fluid flow and relatively narrow in the axial direction, and the grooves are spaced radially.

In another, second, embodiment, the annular chamber extends co-axially about the flow path and the arcuate or annular grooves are spaced axially.

The body may comprise a plurality of parts that when assembled together define the cavity and the fluid outlet arrangement. For example, in the case of the abovementioned first embodiment, the body may comprise a pair of flanges, and the cavity is defined by a recess in one or preferably both of the opposed faces of the flanges. In the case of the second embodiment, one of the body parts may be internally relieved or counterbored to receive a spigot portion of another of the body parts so that said cavity is defined between the spigot portion and the relief or counterbore.

Means, for example, suitable through-holes in the flanges and matching bolts, are provided for clamping the flanges together, and a circumferential seal is provided to prevent escape of lubricating fluid from the cavity.

Advantageously, there can be one, two or more ports in the body for delivering lubricating fluid to the cavity. When two ports are used, they are preferably disposed substantially diametrically opposite and opening into the cavity at or radially outwardly of the outermost of the aforementioned arcuate or annular grooves.

The flanges may be integral with or fitted to respective segments of a conduit for confining the viscous fluid flow.

In an embodiment, means may be provided to selectively deliver and withhold delivery of the lubricating fluid at said outlet arrangements for respective defined periods.

As used herein, except where the context requires otherwise, the term "comprise" and variations of the term, such as "comprising", "comprises" and "comprised", are not intended to exclude further additives, components, integers or steps.

BRIEF DESCRIPTION OF THE DRAWINGS

The invention will now be further described, by way of example only, with reference to the accompanying drawings, in which.

DETAILED DESCRIPTION OF THE EMBODIMENTS

Figure 1:
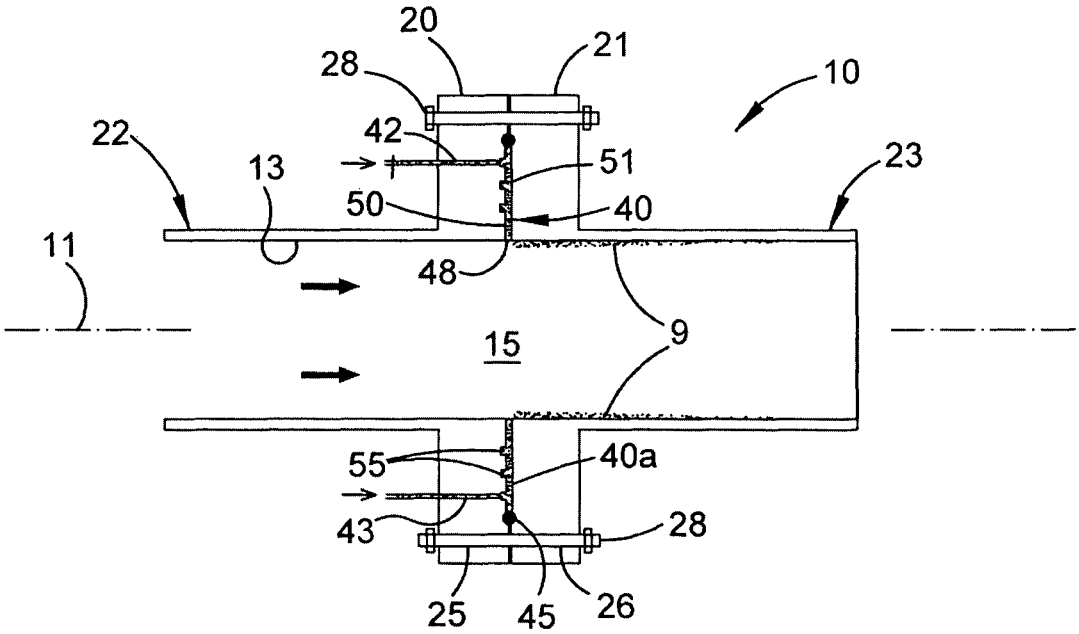
FIG. 1 is an axial cross-sectional diagram illustrating a device according to a first embodiment of the invention.
Figure 2:
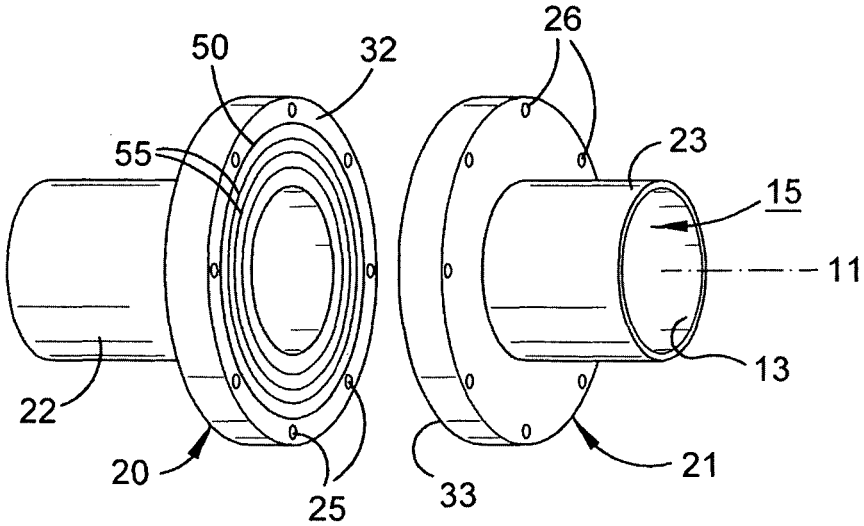
FIG. 2 is an isometric exploded view of the device depicted in FIG. 1.

The device 10 illustrated in FIGS. 1 and 2 is intended to be installed as a segment of a conduit for flow of viscous fluid, for example a slurry paste in a mineral processing plant. Coupling arrangements at each end of the device are not illustrated as they would vary according to the application but typically there may be respective flanges by which the device might be clamped to complementary flanges of further conduit segments or to the outlets or intakes of pumping equipment or processing units.

The device 10 thus constitutes a body positionable to define at least a segment of a flow path 15 for viscous fluid in a conduit. The device may provide the whole conduit or more typically a section of the conduit. This body is formed by a pair of solid annular flanges 20, 21 each contiguous with a respective cylindrical conduit section 22, 23. The flanges have respective rings of complementary through-holes 25, 26 adjacent their outer peripheries for receiving, respective bolts 28 to clamp the flanges together to form the assembled body. The then opposed faces 32, 33 of flanges 20, 21 have respective shallow annular recesses 50, 51 that cooperate to define a cavity 40 in the body for retaining lubricating fluid when the flanges are assembled together. The lubricating fluid is delivered to the cavity 40 by a pair of diametrically opposite ports 42, 43 in flange 20. These ports extend parallel to the central axis 11 of the device and are fitted for coupling (not shown) to a supply of lubricating fluid, which, for example, in a mineral processing application would typically be water under pressure.

Cavity 40 is an annular chamber that exhibits an elongated cross-section that is relatively substantially wider in one direction (in this case the radial direction) and relatively substantially narrower in another direction orthogonal to the one direction (in this case the axial direction). The elongated cross-section thus defines a first annular and a second annular end of the cavity/chamber. The outer periphery or annular end of this cavity is sealed against fluid egress by an O ring seal or other type of seal 45 while the inner periphery or annular end is wholly open and thereby provides a peripherally continuous fluid outlet arrangement 48 from cavity 40 for delivering lubricating fluid to flow path 15 as a film 9 at conduit surface 13.

As mentioned, cavity 40 is defined by matching shallow recesses 50, 51 in opposed flange faces 32, 33. Recess 50 differs from recess 51 in that it has a plurality of continuous annular grooves 55 at radially spaced intervals, typically equal intervals. There are typically three to seven such grooves 55. The grooves comprise passages of cavity 40. Indeed, the radially extending main part of the cavity and the grooves 55 form an array of passages in body 10 of which grooves 55 are elongate passages extending about the flow path. Fluid inlet ports 42, 43 open into cavity 40 in the outermost of grooves 55 that is adjacent the outer annular end of the cavity 40. Grooves 55 are spaced apart between fluid inlet ports 42, 43 and outlet arrangement 48.

It is found that grooves 55 are effective collectively to reduce the pressure variation and therefore velocity variation of the delivered lubricating fluid along outlet arrangement 48. This is thought to be because the lubricating fluid seeps successively into the grooves 55, which might be described as together constituting a labyrinth of grooves, to emerge at the inner conduit surface 13 uniformly, i.e. with no or minimal variation of the pressure and therefore velocity of the delivered lubricating fluid along outlet 48. The arrangement should ideally be such that the pressure of the injected lubricating fluid at ports 42, 43 results in a pressure at outlet 48 that is sufficiently above the radial pressure exerted by the slurry for the lubricating fluid to emerge and form a lubricating film 9 on the conduit wall surface 13 downstream of the outlet, thereby lubricating and improving the flow of the slurry or other viscous flow. Device 10 may therefore be viewed as an effective drag reduction device.

Figure 3:
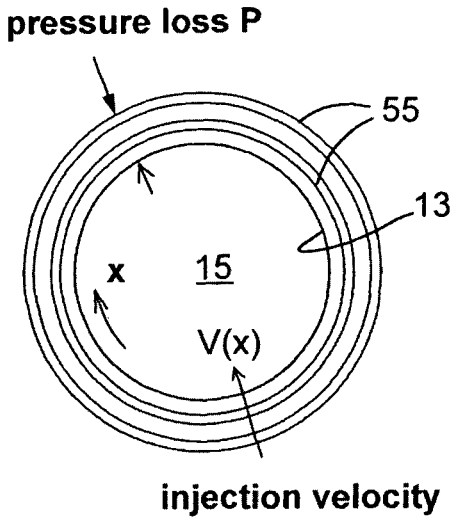
FIG. 3 is a reference diagram in connection with a theoretical analysis set out below.

A brief analysis of the arrangement illustrated in FIGS. 1 and 2 will now be provided, with reference to FIG. 3. The objective is to estimate the influence of the flow pressure variation on the injection velocity distribution, V=V(x), defined normal to the injection surface as shown in FIG. 3. It can be estimated for laminar flow only that:

$$V(x) \propto P = p_i - p(x) \tag{1}$$

where $p_i$ is the injection pressure, and p (x) is the pressure along the circumference (x axis) inside the pipe. It can be determined from (1) that:

$$\frac{\Delta V}{V} \propto \frac{\Delta p}{P} \tag{2}$$

where ΔV is the velocity variation along the pipe circumference (i.e. x-direction) of the pipe, V is the average velocity, i.e. the superficial injection velocity, Δp is the pressure variation, P is the average pressure difference between that at the injection feed and in the flow, i.e. P=avg ($p_i$−p(x)).

Therefore the feed velocity variation can be reduced by increasing the back pressure across the medium by way of grooves 55.

It is thus shown that the feed velocity variation along the circumferential outlet 48 is inversely proportional to the back pressure across the medium and therefore to the number of grooves. The higher the number of grooves, the more uniform the flow becomes annularly. For example, a design with five grooves will produce $1/5^{th}$ of flow variation compared to a single groove, and a design with 10 grooves will produce $1/10^{th}$ of that variation. Preferably, the pressure variation and velocity variation along outlet arrangement 48 is less than 2:1, more preferably less than 1.3:1, most preferably less than 1.1:1.

Figure 4:
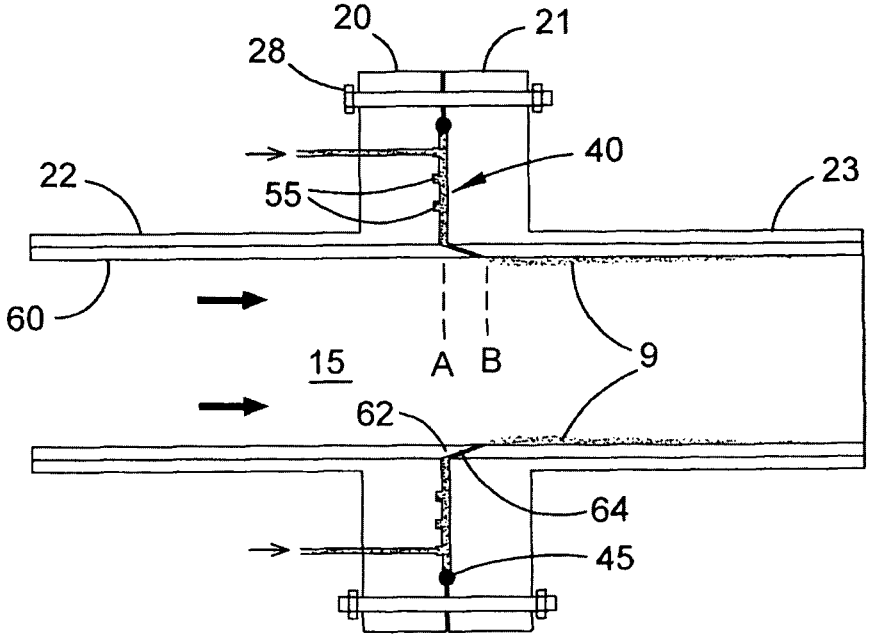
FIG. 4 is a view similar to FIG. 1 of a modified first embodiment applicable to rubber lined slurry pipes.

FIG. 4 depicts a modified embodiment applicable to rubber lined pipes, and especially suitable where it is necessary to turn off the lubricating water flow for long periods of time. To stop solids from entering the outlet 48 and thereby causing blockage during the "injection off" period, a short section 62 of the lining rubber 60 is retained as a flap that closes against the conduit wall 13. Lining flap section 62—extending between points A and B—when closed under its elasticity (and/or by pressure in the pipe) is not fixed to the wall so that it is flexible and can be forced open when the injection flow is turned on. During the injection off period, the lining flap section 62 closes off to stop solids entering the outlet 48. All of the rubber lining except lining flap section 62 is fixed to the wall 13 by glue or other means. The cut end of flap section 62 is indicated by a circumferential gap or slit 64.

Figure 5:
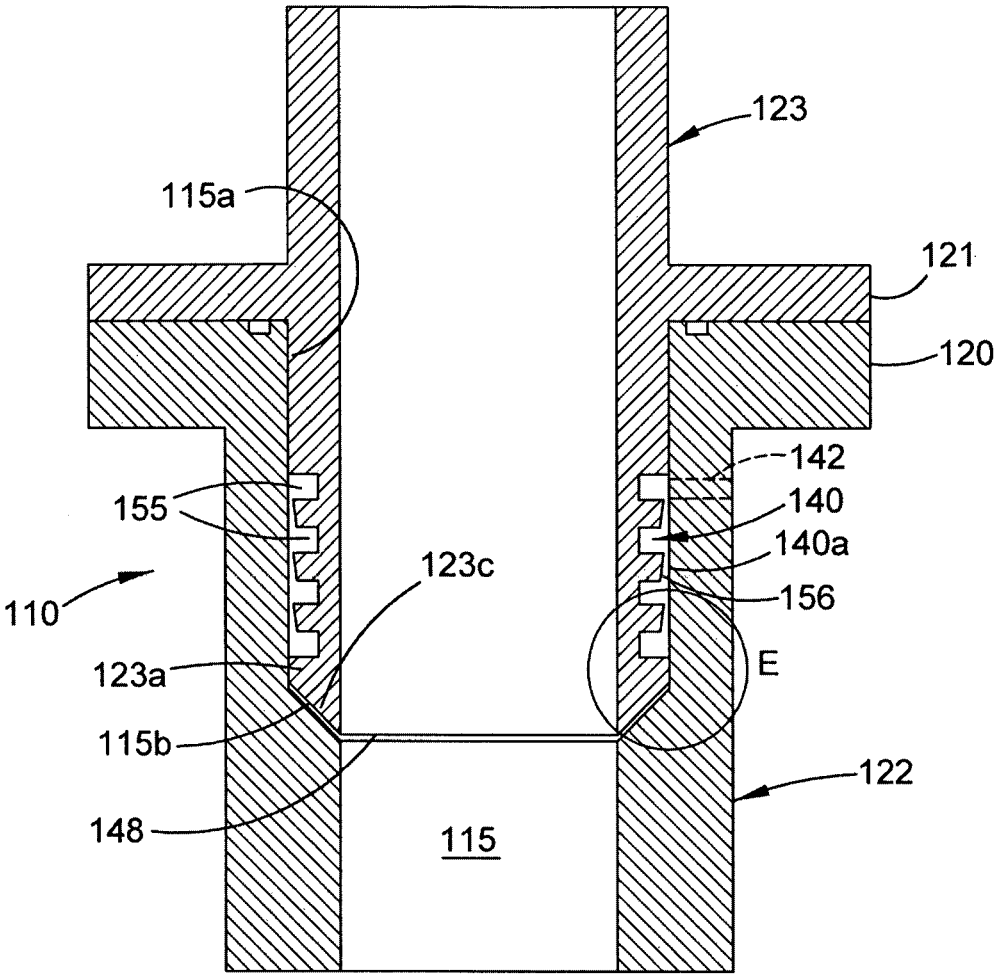
FIG. 5 is an axial cross-sectional diagram illustrating a device according to a second embodiment of the invention.

FIG. 5 illustrates a second embodiment of device 110 in which like parts are indicated by like reference numerals preceded by a "1". In this embodiment, the major dimension of cavity 140 extends co-axially rather than radially, and the grooves 155 are also spaced axially rather than radially. Instead of abutting, the two conduit sections 122, 123 axially overlap. Conduit section 122 is internally relieved or counterbored from its flange end to define a widened portion 115*a* of flow path 115 that receives a spigot or insert portion 123*a* of conduit section 123, so that the internal walls of conduit sections 122, 123 are aligned and substantially contiguous—except for peripherally continuous fluid outlet 148 between the tapered nose 123*c* of the spigot portion 123*a* and the canted shoulder 115*b* of relieved flow path portion 115*a*. Flanges 120, 121 are again clamped together by peripherally spaced bolts.

Grooves 155 are formed on the outer face of spigot portion 123*a* and therefore on the "inner" face of cavity 140. In this case there are four grooves, and the single lubricating fluid injection port 142 extends radially through conduit segment 122 opposite the rearmost of grooves 155 relative to outlet 148.

An advantage of the "in line" embodiment of FIG. 5 relative to that of FIG. 1 is that the average cross-sectional area of the grooves is significantly less. For a given velocity of lubricating fluid outflowing to the pipe, the gap 140*a* in the cavity 140 between the edge face 156 of each rib defined between grooves 155 and the opposing wall of the cavity, can be of significantly greater width (e.g. 50% or more) than gaps 40*a* in FIG. 1. This reduces the risk of clogging by any inadvertent fine particles carried in the lubricating fluid.

Another useful advantage of the alternative arrangement is its compactness: its radial dimension is significantly less at the flange periphery. Indeed, the flanges can be kept as standard flanges in mineral processing plants, whereas the configuration of FIGS. 1 and 2 may cause problems because the flange may not be readily accommodated if there is closely adjacent other pipework.

Figure 6:
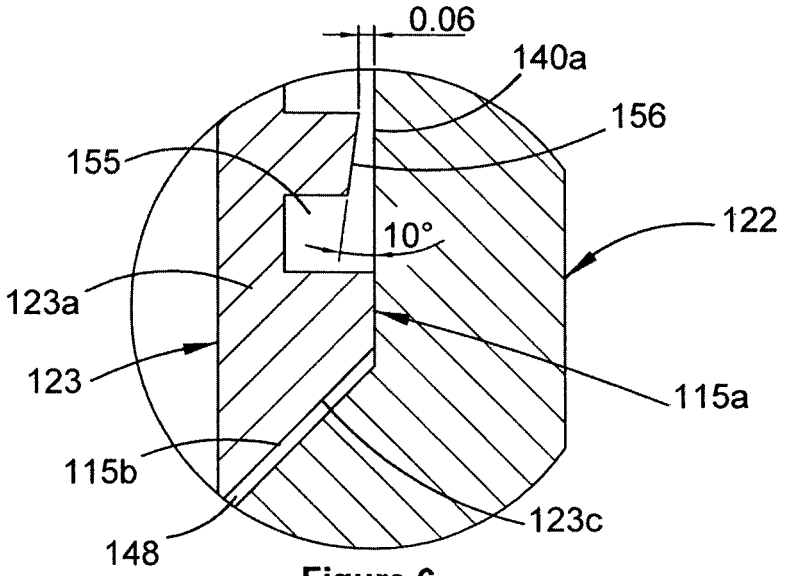
FIG. 6 is an enlarged fragmentary view of region E in FIG. 5, highlighting tapering of the ribs.

The incidence of clogging by inadvertent particles within the lubricating fluid is further reduced in the embodiment of FIG. 5 (and can be correspondingly reduced in the embodiment of FIG. 1), by transversely tapering the peripheral edge faces 156 of each rib defined between grooves 155 so that the narrowest dimension of gaps 140*a* is at the upstream side, and the flow expands out from that narrower dimension. This feature is highlighted in the fragmentary enlarged view of FIG. 6.

Figure 7:
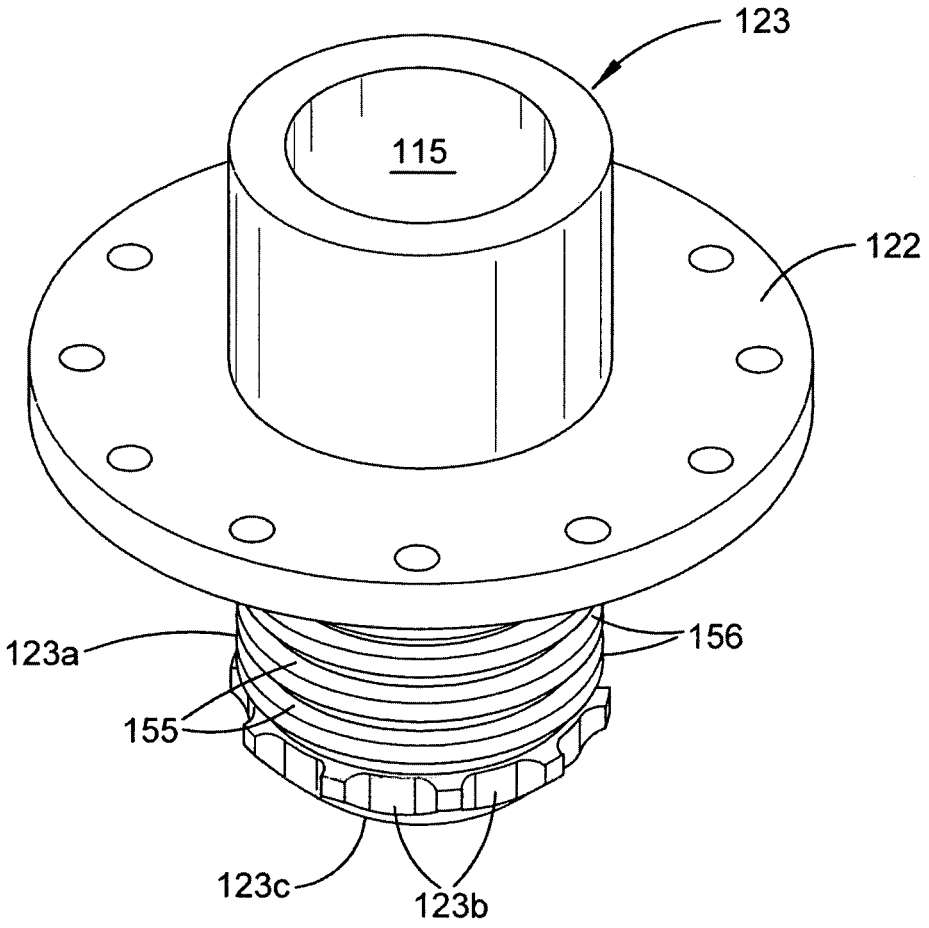
FIG. 7 is an isometric view of one of the conduit sections of the device depicted in FIG. 5, additionally showing location keys.

In the "in line" embodiment of FIG. 5, to ensure that the spigot or insert portion 123*a* is accurately aligned and not askew despite the presence of the gap at fluid outlet 148, and therefore that outlet 148 is uniform, peripherally spaced outstanding location keys 123*b* (FIG. 7) are provided at the tip of spigot portion 123*a*.

Figure 8:
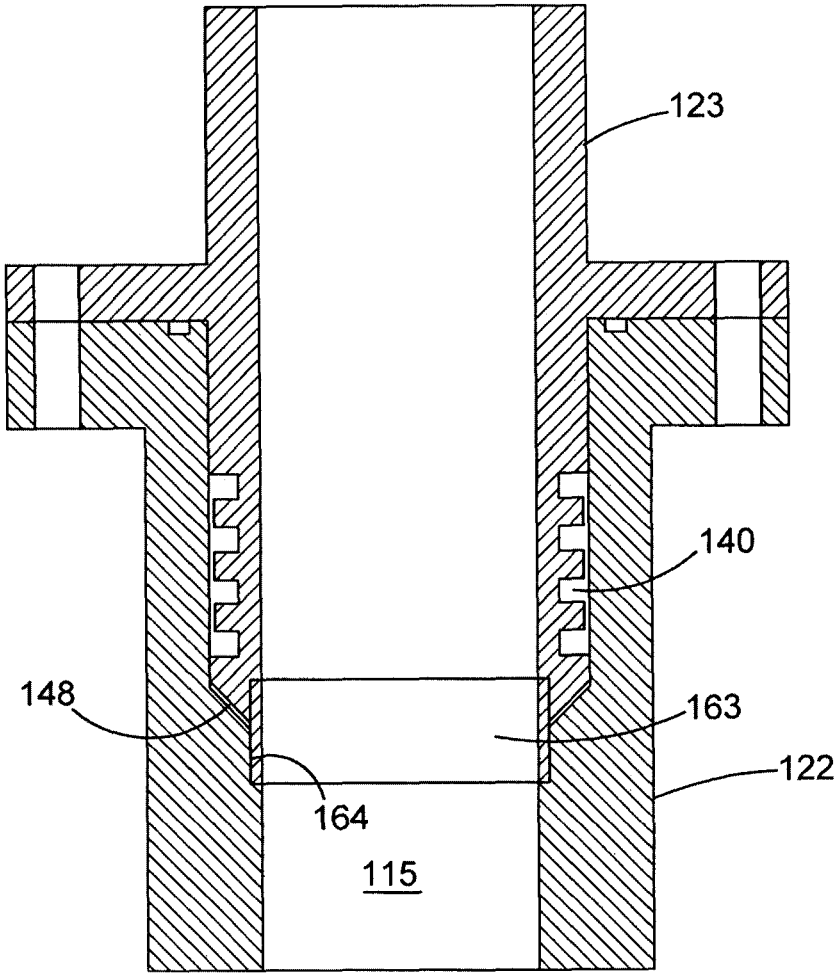
FIG. 8 is a view similar to FIG. 5, illustrating the provision of a one-way flap valve.

If desired, and as illustrated in FIG. 8, fluid outlet 148 can be controlled (as earlier described for the FIG. 4 modification) by a one-way flap valve provided as a sleeve 163 of rubber set into a complementary recess 164 defined at outlet 148 in both conduit components. This flap opens under lubricating fluid pressure but closes in its absence to prevent ingress of slurry or slurry particles to cavity 140. In the modification of FIG. 8, the tapering of edge faces 156 is omitted but may of course be included if desired.

It will be understood that, in typical applications, the lubricating fluid will be a liquid, most often water, but it may also be a non-aqueous liquid such as an oil. The lubricating fluid may alternatively be a gas or a gas within a liquid and may include additives such as a viscosity modifier. It is envisaged that the illustrated device may be beneficial for dosing chemicals into a pipeline, for example for protecting pipe internals against scaling and corrosion, with the desire to minimise the required chemical volume rates. Another potential application of the device is to deliver other reagents to a flowing viscous fluid, for example reagents that would reduce the impact of acid mine drainage from mineral tailings.

More than one device 10,110 may be provided in line in a fluid transport system, for example spaced at intervals along the length of the transport conduit and/or positioned at the inlet and/or outlet sides of a pump.

It may be useful for the internal surface of the circumferential outlet 48,148 to be machined with very rough finishing to widen the jet spread; this will minimise the diffusion of the injection flow into the bulk slurry.

A particular benefit of the uniform film achievable with a device according to the invention is the ability to minimise the proportion of lubricating fluid added to the viscous fluid. Where, as would be common, the lubricating fluid is water, the proportionate addition of water relative to the water already present in the viscous flow can be as low as 1%. This is particularly beneficial where alteration of the water proportion may be undesirable or detrimental and has the further beneficial consequence that a number of the devices may be able to be used in a single conduit without excessive addition of water to the viscous fluid, for example a mineral slurry, carried by the conduit.

Tests at high viscosities (30-40 Pa yield stress) lead to an estimation that for the drag reduction performance achieved at an injection ratio of 1% of the pipe flow using the embodiment of FIG. 1 or 5, an injection ratio of ~1.4% is required using the device disclosed in U.S. Pat. No. 5,361,797. This means a ~40% saving in the injection flow for the same performance, for the test viscosities. The test velocities were 1 m/s and 2 m/s.

In general, the pressure and rate of flow of the lubricating fluid are arranged so that the lubricating fluid constitutes between about 0.05% and about 10% of fluid flowing through the flow path downstream of the device. More particularly, the lubricating fluid may constitute between about 0.05% and about 5% of fluid through the downstream passage. More particularly still, the lubricating fluid may constitute between about 0.1% and about 2% of fluid through the downstream passage, for example between about 1.0% and about 1.5% or between about 0.1% and about 1.0%.

It has been found that after the injection is turned off, the "drag reduction" performance typically continues for a while before dissipating. It may therefore be beneficial to pulse the injection flow, i.e. switch on and off, say 10 seconds on and 10 seconds off. Such pulsation would save 50% water used in the injection.

The invention claimed is:

1. A method of reducing friction of a viscous fluid flow in a conduit, comprising delivering lubricating fluid to the flow from a cavity via an outlet arrangement provided in a body, wherein said body comprises a pair of annular flanges each contiguous with a respective conduit section, wherein opposed faces of said flanges cooperate to define the cavity when the flanges are assembled together, and a radially extending main part of the cavity forms an array of passages in said body that includes a plurality of radially spaced elongate passages, and said fluid outlet arrangement comprises a substantially continuous opening or ring of close spaced openings, effective collectively to reduce the pressure variation and therefore velocity variation of the delivered lubricating fluid along said outlet arrangement.

2. The method according to claim 1, wherein the cavity comprises an annular chamber about the flow path, and said elongate passages include a plurality of grooves radially spaced apart between said at least one port and said fluid outlet arrangement on one or other of opposed faces of the annular chamber.

3. A device for reducing friction of a viscous fluid flow in a conduit, the device comprising:

a body positionable to define at least a segment of a flow path for the viscous fluid in or contiguous with the conduit;

a cavity in the body for retaining lubricating fluid, and at least one port in the body for delivering lubricating fluid to the cavity; and a fluid outlet arrangement from said cavity for delivering lubricating fluid to the flow path to form a downstream lubricating film at a conduit surface;

wherein said body comprises a pair of annular flanges each contiguous with a respective conduit section, wherein opposed faces of said flanges cooperate to define the cavity when the flanges are assembled together, and a radially extending main part of the cavity forming an array of passages in said body that includes a plurality of radially spaced elongate passages, and said fluid outlet arrangement comprises a substantially continuous opening or ring of close spaced openings, effective collectively to reduce the pressure variation and therefore velocity variation of the delivered lubricating fluid along said outlet arrangement.

4. The device according to claim 3, wherein the cavity comprises an annular chamber defined by shallow recesses in said opposed flange faces, and said radially spaced elongate passages include a plurality of grooves spaced apart between said at least one port and said fluid outlet arrangement on one or other of opposed faces of the annular chamber.

5. The device according to claim 4, wherein said plurality of grooves comprises three to seven such grooves.

6. The device according to claim 4, wherein said plurality of grooves are arcuate or annular about said flow path.

7. The device according to claim 4, wherein the annular chamber exhibits an elongated cross-section that is wider in a radial direction relative to an axis of the viscous fluid flow and narrower in an axial direction orthogonal to said radial direction, whereby said elongated cross-section defines a first annular end and a second annular end of said annular chamber.

8. The device according to claim 7, wherein the fluid outlet arrangement comprises an open end of the annular chamber at said first annular end.

9. The device according to claim 8, wherein said at least one port is at or adjacent said second annular end of the annular chamber.

10. The device according to claim 3, wherein the body includes suitable through-holes in the annular flanges and matching bolts are provided for clamping the annular flanges together, and a circumferential seal is provided to prevent escape of lubricating fluid from the cavity.

11. The device according to claim 3, the annular flanges are integral with or fitted to respective segments of the conduit for confining the viscous fluid flow.

* * * * *